US005503269A

United States Patent [19]

DeBiasio

[11] Patent Number: 5,503,269

[45] Date of Patent: Apr. 2, 1996

[54] DISPLAY DEVICE

[75] Inventor: Brain F. DeBiasio, Hamilton, N.J.

[73] Assignee: Sara Lee Corporation, Winston-Salem, N.C.

[21] Appl. No.: 422,716

[22] Filed: Apr. 12, 1995

[51] Int. Cl.[6] ..... B65D 85/18

[52] U.S. Cl. ..... 206/296; 206/45.14; 206/299

[58] Field of Search ..... 206/45.14, 278, 206/279, 284, 289, 281, 292, 296, 297, 299; 229/117.18; 211/113, 118

[56] References Cited

U.S. PATENT DOCUMENTS

| | | | |
|---|---|---|---|
| 2,755,924 | 7/1956 | Tuttle et al. | 206/296 |
| 2,816,653 | 12/1957 | Jacobi | 206/299 X |
| 2,908,308 | 10/1959 | Dearholt | 206/299 X |
| 2,911,093 | 11/1959 | Burton | 206/297 X |
| 2,915,173 | 12/1959 | Langdon | 206/297 X |
| 3,037,621 | 6/1962 | Jackman | 206/296 X |
| 3,415,359 | 12/1968 | Vrana | 206/299 |
| 3,794,793 | 2/1974 | Rius | 206/299 X |
| 4,601,417 | 7/1986 | Kunreuther | 206/296 X |
| 5,193,676 | 3/1993 | Gold | 206/296 |

FOREIGN PATENT DOCUMENTS

| | | | |
|---|---|---|---|
| 2399365 | 4/1979 | France | 206/296 |

*Primary Examiner*—Allan N. Shoap
*Assistant Examiner*—Christopher J. McDonald

[57] ABSTRACT

A device for displaying a pair of articles such as gloves having a sleeve with a front, a back, and sides connecting the front and back to form an opening therein. The back has an upwardly extending top portion with stepped side edges and a clamp receiving opening. A pair of articles engage the sleeve, one extending through the opening of the sleeve and the other article disposed outside the sleeve and adjacent the other article. Means engage the back top portion and the pair of articles and maintain the sleeve and pair of articles in a displayed condition.

11 Claims, 1 Drawing Sheet

DISPLAY DEVICE

BACKGROUND OF THE INVENTION

1. Field of the Invention

The present invention relates generally to display devices and more particularly to a display sleeve for supporting and displaying a pair of articles in a hanging condition on a fixture to maximize viewability and present decorative and informational indicia in a manner heretofore unattainable.

2. Description of the Prior Art

Various techniques have been used to present paired articles like gloves and socks such as tacking these articles onto a collar band, the band being equipped with a hook or recess to engage a peg or slot on a fixture. Gloves, for example, are traditionally swift-tacked onto a collar band by simply extending a thread through the glove and band. While this technique is suitable for non-leather gloves, it is not appropriate for leather gloves since it results in a hole in the leather where the tack was inserted.

Various boxes have been used for supporting and displaying paired articles; however, this many times results in the customer not being able to feel the material of the articles and leaving the packages open and consequently damaged to some degree. In many instances, it is preferable to hang the gloves in a substantially exposed condition so that the customer may closely examine and feel the product first hand without affecting its packaging to any extent.

Because of various problems associated with displaying paired articles and particularly, the problems associated with supporting and displaying paired leather gloves, there is an ongoing need to develop more sophisticated and efficient display accessories for such articles in an attractive and convenient manner. It is too this ongoing and critical need that the present invention is directed.

OBJECTIVES AND SUMMARY OF THE INVENTION

It is an objective of the present invention to provide a display device that has all and more of the advantages of prior art devices and none of the disadvantages.

Another objective of the present invention is to provide a display device of the type described that will avoid damaging the displayed paired articles by piercing their exterior with a tack or pin.

Yet another objective of the present invention is to provide a display device of the type described that enables the display of paired articles in a preferred exposed condition by utilizing a sleeve to display the paired articles in an attractive side-by-side arrangement.

A further objective of the present invention is to provide a sleeve of the type described having a novel design and capable of carrying decorative and informational indicia from the manufacturer and from the retail customer including a color coded lining system that designates, for example, the type of lining in a displayed pair of gloves.

The display device comprising the invention includes a sleeve having a front, back, and sides connecting the front and back to form an opening therein with the back having an upwardly extending top portion with stepped side edges and a clamp receiving opening. A pair of articles are positioned in a side-by-side relationship one extending through the opening of the sleeve and the other disposed outside the sleeve opening and adjacent the sleeve back. The pair of articles and the top of the sleeve are secured by appropriate means to enable the displayed article pair to be hung from a fixture in a traditional manner.

Thus, there has been outlined in summary form the more important features of the invention in order that the detailed description that follows may be better understood and in order that the present contribution to the art may be better appreciated. There are obviously additional features of the invention that will be described hereinafter and which will form the subject matter of the claims appended hereto. It is to be understood that the invention is not limited in its application to the details of construction and to the arrangement of the components set forth in the following description or illustrated in the drawings. The invention is capable of other embodiments and of being practiced and carried out in various ways.

It is also to be understood that the phraseology and terminology herein are for the purpose of description and should not be regarded as limiting in any respect. Those skilled in the art will appreciate the concept upon which this disclosure is based and that it may readily be utilized as a basis for designing other structures, methods and systems for carrying out the several purposes of the present invention. It is also to be understood that the abstract is neither intended to define the invention of the application, which is measured by the claims, nor to limit its scope in any way.

This summary and these objectives of the invention, along with the various features of novelty which characterize the invention, are pointed out with particularity in the claims annexed to and forming a part of this disclosure. For a better understanding of the invention, its operating advantages and the specific objects obtained by its use, reference should be made to the accompanying drawings and descriptive matter in which like characters of reference designate like parts throughout the several views.

DETAILED DESCRIPTION OF THE PREFERRED EMBODIMENT

Figure 1:
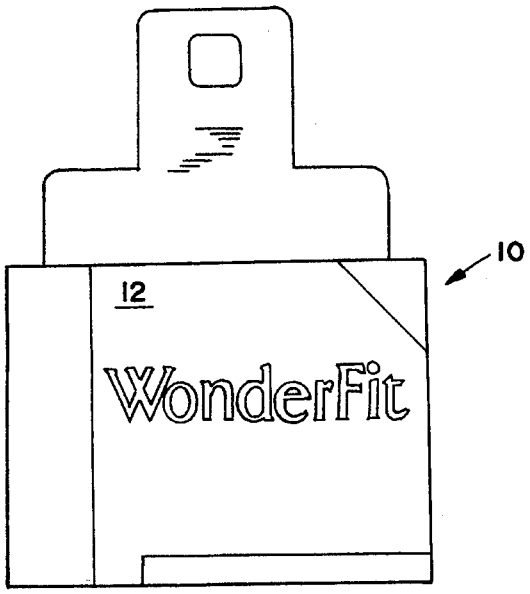
FIG. 1 is a front elevational view of the sleeve of the display device comprising the present invention.
Figure 2:
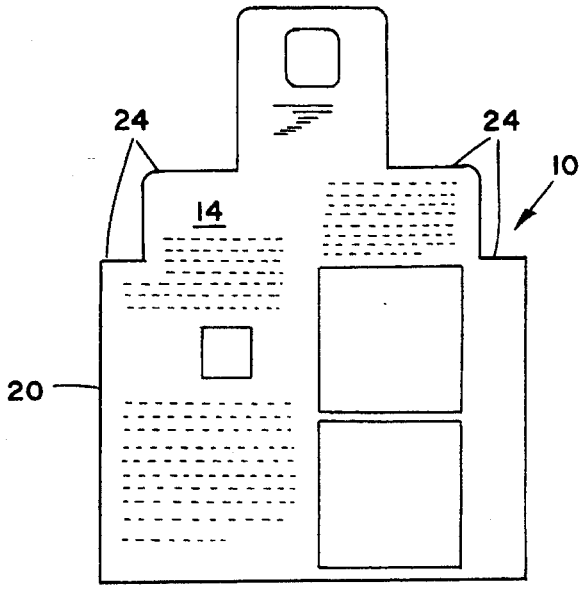
FIG. 2 is a rear elevational view of the sleeve of the present invention shown in FIG. 1.
Figure 3:
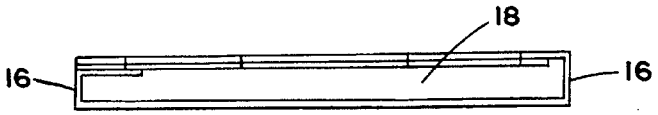
FIG. 3 is a plan view of the sleeve of the present invention shown in FIGS. 1 and 2.

With reference to the drawings and particularly to FIG. 1, a sleeve shown generally as 10 has a front 12, a back 14, and sides 16 connecting the front and back and forming an opening 18 therein. Front 12 may be of any size; however, it has been found desirable to have the width of the front to be greater than the height to emphasize and show more of the material of the displayed articles.

Back 14 has a main portion 20 that is substantially the same size of and aligned with front 12. Back 14 also has an upper portion 22 preferably integral with main portion 20 but having two stepped side edges 24 extending upwardly and inwardly until the upper portion width has decreased to form an upper portion top 26. Upper portion top 26 has a clamp receiving opening 28.

Figure 4:
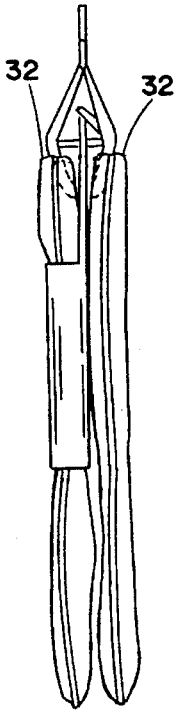
FIG. 4 is a side elevational view of the display device comprising the present invention wherein a pair of gloves are supported in a palm-to-palm hanging relationship.

A pair of articles, in this case gloves 30, engage sleeve 10—one glove extending through sleeve opening 18 and the other glove disposed outside sleeve 10 and adjacent sleeve back 14. The gloves 30 are preferably disposed in a front or palm-toward-palm relationship so that the lower edge 32 of gloves 30 are substantially aligned with upper portion top 26 to enable a suitable clipping device 34 to grip one thickness of each glove and the upper portion top 26 in the manner best shown in FIG. 4. Clip 34 squeezes the single thickness of each glove toward each other so that they are held firmly at clamp receiving opening 28. Any number of hooks and clips are acceptable for this purpose, a commonly used one being a bats clip that has a hook portion to engage a post or pin on a display for hanging the packaged articles.

The sleeve has ample room for carrying decorative and informational indicia such as company name, appropriate trademarks, color codes, for example, to designate the kind of linings in the particular model displayed, and legal information about fiber content, care instructions, and guarantees as well as spaces for placement of manufacturers' special labeling and suggested pricing and retail ticketing. Information can be carried on both sleeve front 12 and sleeve back 14 since it is easily readable by lifting the displayed article that resides outside the sleeve. Clip 34 can be designed to feature both alphabetical and numeric sizing to allow for better consumer shoppability such as that now available in men's belts.

While the embodiment described herein is, at present, considered to be preferred, it is understood that various modifications and improvements may be made therein, and it is intended to cover in the appended claims all such modifications and improvements as fall within the true spirit and scope of the invention.

What is claimed is:

1. A device for displaying a pair of articles comprising: a sleeve having a front, a back, and sides connecting the front and back and forming an opening therein, the back having an upwardly extending top portion with stepped side edges and having a clamp receiving opening; a pair of articles having fronts and backs, said articles engaging the sleeve, one of the articles extending through the opening of the sleeve and the other article disposed outside the sleeve opening and adjacent the sleeve back; and means engaging the back top portion and the pair of articles and maintaining the sleeve and pair of articles in a displayed condition.

2. The device as claimed in claim 1 wherein the sleeve front carries decorative and informational indicia.

3. The device as claimed in claim 1 wherein the sleeve back carries informational indicia.

4. The device as claimed in claim 2 wherein the sleeve back carries informational indicia.

5. The claim as claimed in claim 4 wherein the articles are positioned through an adjacent sleeve in a front toward front relationship.

6. The device as claimed in claim 1 wherein the paired articles are gloves.

7. The device as claimed in claim 6 wherein the paired articles are gloves.

8. A device for displaying a pair of gloves, each glove having a palm portion and a back portion, the device comprising: a sleeve having a substantially rectangular front with a width greater than the height, a back, and sides connecting the front and back and forming an opening therein, the back having a main portion substantially the size of and aligned with the front and an upper portion having two stepped side edges commencing at the back portion and extending upwardly whereby the upper portion width decreases as the stepped side edges extend upwardly to form an upper portion top, the upper portion top having a clamp receiving opening therein; a pair of gloves engaging the sleeve, one of the gloves extending through the sleeve opening and the other glove disposed outside of the sleeve and adjacent the sleeve back; and means engaging the back top portion and the pair of gloves to secure the glove pair to the sleeve and maintain the glove pair and the sleeve in a displayed condition.

9. The device as claimed in claim 8 wherein the sleeve front carries decorative and informational indicia.

10. The device as claimed in claim 9 wherein the sleeve back carries information indicia.

11. The device as claimed in claim 10 wherein the gloves are positioned through and adjacent the sleeve in a palm toward palm relationship.

* * * * *